United States Patent [19]

Gunther

[11] 4,162,704

[45] Jul. 31, 1979

[54] PRESSURE CONTROL DEVICE

[76] Inventor: Albert W. Gunther, P.O. Box 615, Harvey, La. 70059

[21] Appl. No.: 880,370

[22] Filed: Feb. 23, 1978

[51] Int. Cl.[2] ..... E21B 19/16

[52] U.S. Cl. ..... 166/77.5; 166/77; 166/81; 166/82; 254/29 R

[58] Field of Search ..... 166/82, 81, 77.5, 77, 166/83, 78, 75 R; 254/29, 30, 31

[56] References Cited

U.S. PATENT DOCUMENTS

| | | | |
|---|---|---|---|
| 1,819,211 | 8/1931 | Tomeshko | 173/39 X |
| 2,994,379 | 8/1961 | Brown | 166/81 |
| 3,096,075 | 7/1963 | Brown | 254/29 R |
| 3,100,015 | 8/1963 | Regan | 166/77 |
| 3,797,570 | 3/1974 | Leutwyler | 166/77 |
| 3,999,610 | 12/1976 | Sage et al. | 166/77 |

*Primary Examiner*—William Pate, III

*Attorney, Agent, or Firm*—Arnold, White & Durkee

[57] ABSTRACT

A pressure control device is disclosed which forms a pressure containing enclosure around a tubing string coupling to contain therein any released pressure as the tubing is uncoupled. Means are provided to form a pressure seal against the outside surface of the tubing string above and below the pipe coupling. This means also includes a blowout preventor to seal off the open end of the tubing string in the presence of uncontrolled release of fluids and gases. Lifting means are provided to raise and lower the pressure containing enclosure, to permit exposing the open end of the tubing string above the device for the safe and rapid attachment of a safety valve. Slip sets are provided to grip the lower and upper joints of pipe to support the weight of the tubing string and to allow the upper joint to be rotated relative to the lower joint to thereby uncouple the joints. Means are provided to plumb the device to align the central opening of the pressure control device, through which the tubing string passes, with the axis of the string. The central opening of the pressure containing enclosure is of sufficient diameter to permit the passage of tools and controls of larger diameter than the tubing but which are part of the tubing string.

21 Claims, 3 Drawing Figures

PRESSURE CONTROL DEVICE

BACKGROUND OF THE INVENTION

1. Field of the Invention

This invention relates to a well apparatus and, in particular to a pressure control device for the controlled containment and release of entrapped pressure in a plugged tubing string as the string sections are uncoupled.

2. Description of the Prior Art

In the operation of an oil or gas well in which production is obtained through tubing extending through a larger size casing, it often becomes necessary for the operator to extract the tubing for repair, inspection, or replacement. Occasionally, during production of the well, the tubing string becomes plugged in one or more places with sand, paraffin, or other contaminants requiring the removal of the tubing string to locate and remove the plugs.

The tubing string is raised a joint at a time. As each joint is raised from the well, it is unscrewed and checked for plugs. After the topmost joint of pipe has been removed from the next succeeding joint, the raising mechanism connects to the open end of the new top joint of pipe to continue the sequence of raising the tubing string. For those wells in which the fluids or gases are subjected to high pressures within the earth's formations, considerable danger exists during the extraction of the string because of the presence of high pressure product trapped or plugged in the tubing string. This pressure may suddenly be released upon disconnection of the sections of the tubing string.

In an effort to eliminate the hazards to life and property that this released pressure presents, pressure-control devices have been employed to contain this released pressure and allow for its controlled disposal.

A typical example of a prior-art pressure-control device for removing a plugged drill string is shown in U.S. Pat. No. 2,994,379 to C. C. Brown, et al. The prior-art pressure-control device exemplified by the above-mentioned patent includes a tubular body containing a pair of sealing units located at opposite ends of the body. The sealing units have a central opening through which the tubing string passes. The body contains two side connections. A pressure gauge in series with a release valve is secured to one of the side connections while a disposal line in series with a second release valve is secured to the opposite connection. The release valve and disposal line are used to bleed off the pressurized fluid from the interior of the tubular body. The two sealing units are longitudinally spaced from each other to accommodate between them the threaded pipe connection of the tubing string that is next to be uncoupled. Located above and below the two sealing units are slip sets for gripping the tubing string above and below the threaded pipe connection.

In operation, the threaded pipe connection is disconnected with the connection located between the upper and lower sealing units. Having disposed of any released pressure, the upper joint is removed from the device. After removing the upper joint, a safety valve must be lowered through the uppermost slips, through the upper sealing unit and mated to the open end of the tubing string. This operation is complicated because of the weight involved and the fact that the crew cannot see the threads to be mated. The crew must use trial and error to engage the threads. While attempting to engage these threads, the crew must have their hands and bodies in contact with a safety valve and above the top of the pressure control device. Any jarring or bumping of the tubing string could cause the plug in the tubing to release and expose the crew to the blast of suddenly released pressure. It would also leave them with no immediate method of stopping the flow. Additionally, the sealing units of this prior-art pressure-control device were constructed with restricted internal diameter rubber sealing portions constantly in contact with the tubing being hoisted from the well. As a result, many tools and devices which were a part of the tubing string but of a greater outside diameter than the tubing, could not be hoisted through the pressure-control device.

It is an improvement, therefore, to provide a pressure-control device in which the open end of the tubing string following disconnection of the topmost joint of pipe can be exposed above the pressure control device for connection to the safety valve without exposing the crew to unnecessary dangers. It is a further improvement to provide a pressure containing device that can be elevationally adjusted relative to the threaded pipe connection to position the sealing units relative to the threaded pipe connection. It is also an improvement to provide a pressure-containing device with a blowout preventor that can be positioned above the open end of the tubing string, and closed to shut off any uncontrolled flow of pressurized fluids or gases from the open end of the tubing string. It is also an improvement to provide a pressure-control device having an internal bore diameter larger than the largest outside diameter of the drill string so that the drill string may be raised unobstructed through the pressure-control device. It is also an improvement to provide a pressure-control device that can be coaxially aligned with the axis of the tubing string, to permit lifting of the string without interference with the internal bore of the device. It is also an improvement to provide a pressure-control device capable of permitting upward movement of the pressure-containing device as the threaded pipe connection is unscrewed and to absorb the shock of any released pressure tending to force the unscrewed top length of tubing out of the pressure-containing device.

SUMMARY OF THE INVENTION

A preferred embodiment of the present invention comprises a lower and upper slip set assembly, a pair of hydraulically actuated pistons, a pair of hydraulic fluid accumulators associated with the hydraulic pistons and a series connection of various pressure sealing devices which provide a pressure enclosure around a threaded pipe connection in a tubing string.

The lower slip set assembly contains a set of slips to grip the string below a threaded pipe connection to support the weight of the string and to prevent rotation of the lower joint of pipe. The lower slip set assembly provides a base to which the remaining elements of the pressure-control device are attached. Included with the lower slip set assembly is a set of adjusting screws to plumb the entire pressure-control device.

The upper slip set assembly contains a set of slips for securely gripping an upper joint of pipe above a threaded pipe connection to prevent any upward movement of the pipe relative to the upper slip set assembly. The upper slip set assembly is rotatable to thereby provide the rotation necessary to unscrew the threaded pipe connection.

Suspended below the upper rotatable slip set assembly is the serial connection of elements comprising the pressure-control assembly within which the threaded pipe connection is disconnected. The pressure-control assembly is composed, from top to bottom, of a ram blow out preventor, an upper sealing unit, a pressure containing chamber and a lower sealing unit. The ram blow out preventor is used to close off the central opening of the pressure control assembly above the open ended string when an uncontrolled flow of fluids or gases is escaping through the open pipe connection. The upper and lower sealing units are used to provide a pressure seal against the outside wall of the joints of pipe in the tubing string above and below the threaded pipe connection. The pressure-control chamber interposed between the upper and lower sealing units provides a housing around the threaded pipe connection during disconnection to contain any released pressure between the pressure seals above and below the pipe connection. Pressure release valves are connected to the chamber through which the pressure within the control chamber is monitored and through which pressurized fluids or gases within the chamber are transferred to a disposal area.

A pair of hydraulic pistons connect the upper slip set assembly to the lower slip set assembly. The hydraulic piston piston cylinders are attached to the lower slip set assembly while the hydraulic pistons, contained and movable within the cylinders, are attached to the upper slip set assembly. The hydraulic pistons are used to position the pressure-control assembly so that the tubing connection is contained within the pressure chamber prior to disconnection, and that following disconnection, the open end of the tubing string can be exposed above the pressure-control device for the safe and rapid connection of the safety valve.

Associated with each of the hydraulic pistons is a fluid accumulator that serves two functions. First, the accumulators allow for slight upward extensions of the upper slip set assembly necessary to accommodate the increasing length of the string between the upper and lower slip set assemblies during disconnection of the connection. Secondly, the accumulators act as shock absorbers to dissipate the forces generated by released pressure upon disconnection of the connection which acts to force the upper joint of tubing out of the pressure-control assembly.

BRIEF DESCRIPTION OF THE DRAWINGS

The novel features believed characteristic of this invention are set forth in the appended claims. The invention and advantages thereof may best be understood by reference to the following detailed description of illustrative embodiments, when read in conjunction with the accompanying drawings which form a part of this specification, in which corresponding numerals indicate corresponding parts.

In the drawings.

DESCRIPTION OF THE PREFERRED EMBODIMENT

Figure 1:
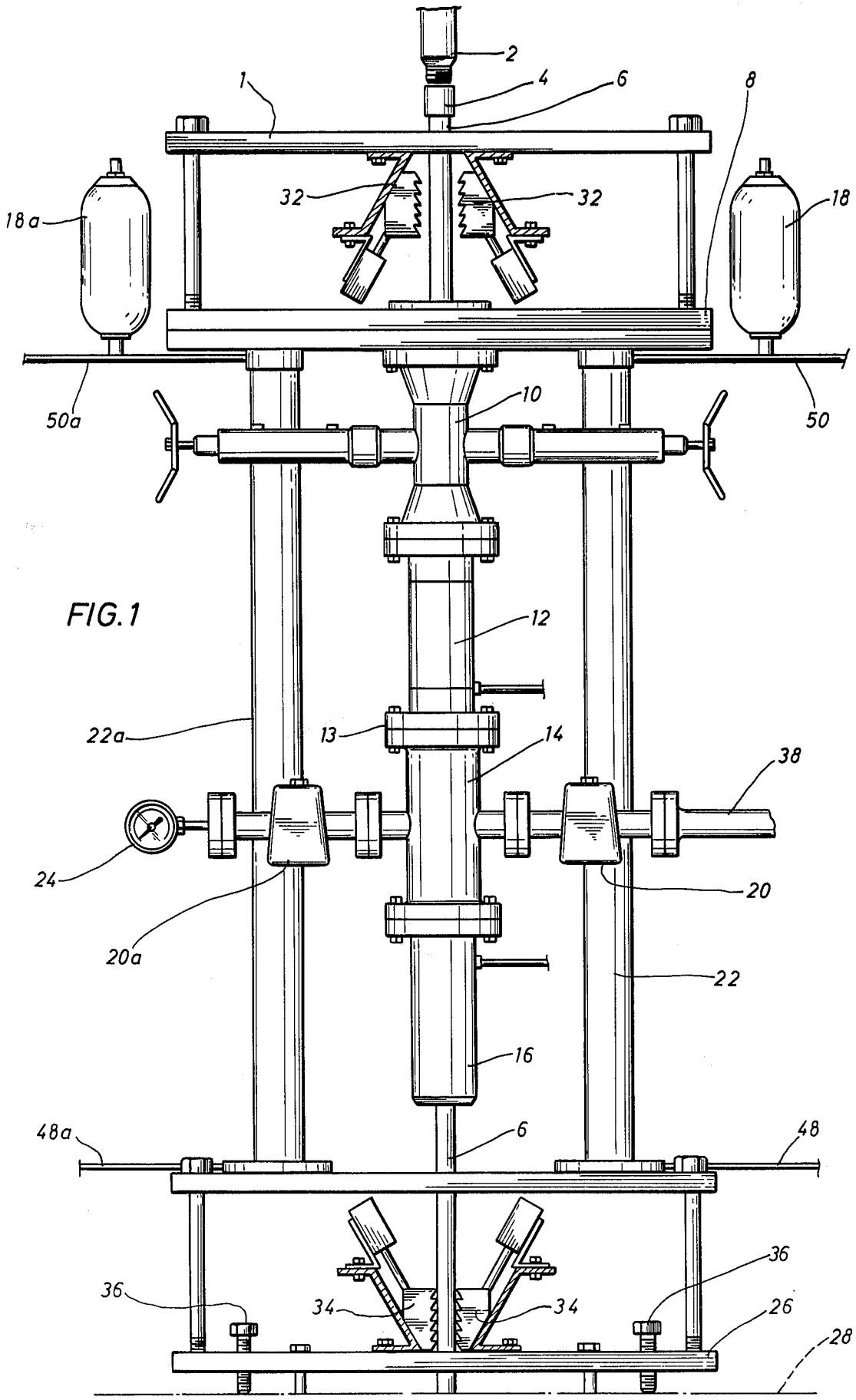
FIG. 1 is a composite view of the pressure control device in its fully collapsed position, showing the open-ended tubing string above the device awaiting connection of the safety valve.

Referring to the drawings and first to FIG. 1, a pressure control device 1 embodying this invention is shown in place on a rig floor over a well from which the tubing string is to be extracted. The pressure control device 1 is in its fully collapsed position with the open end of pipe joint 6 extended above the device. The open end of pipe joint 6 contains a threaded pipe connection 4 that is typical of the connections that are used to couple the joints of pipe that comprise the tubing string. The topmost joint of pipe in the tubing string is shown extending from the well bore hole and passing through the lower stationary slip set assembly 26, the lower sealing unit 16, the pressure containing chamber 14, the upper sealing unit 12, the blowout preventor 10 and the upper rotatable slip set assembly 8. The lower slip set 34 is shown engaging pipe joint 6 to support the weight of the remaining joints of the tubing string while the safety valve 2 is shown in position for attaching to the open end of the tubing string at the threaded pipe connection 4.

The lower stationary slip set assembly 26 provides a base platform on which are mounted two hydraulic piston assemblies. Hydraulic cylinders 22 and **22*a*, which comprise the outer housings of the piston assemblies, are mounted to the lower stationary slip set assembly. Hydraulic pistons 40 and 40*a* (FIG. 2) which are contained within the hydraulic cylinders 22 and 22*a*, respectively, are connected to the upper rotatable slip set assembly 8. Suspended below the upper slip set assembly 8, in a serial fashion, is a blowout preventor 10, an upper sealing unit 12, a pressure containing chamber 14 and a lower sealing unit 16. Hydraulically connected to the top end of the hydraulic cylinders 22 and 22*a* are fluid accumulators 18 and 18*a*, respectively. Connected to opposite sides of the pressure-containing chamber 14 are two pressure release valves 20 and 20*a*. Attached to release valve 22*a* is a pressure gauge 24 for indicating the internal pressure of the pressure containing chamber 14. Pressure release valve 22 is connected to a product disposal line 38** through which will flow the pressurized fluids or gases released within the pressure control chamber.

Figure 3:
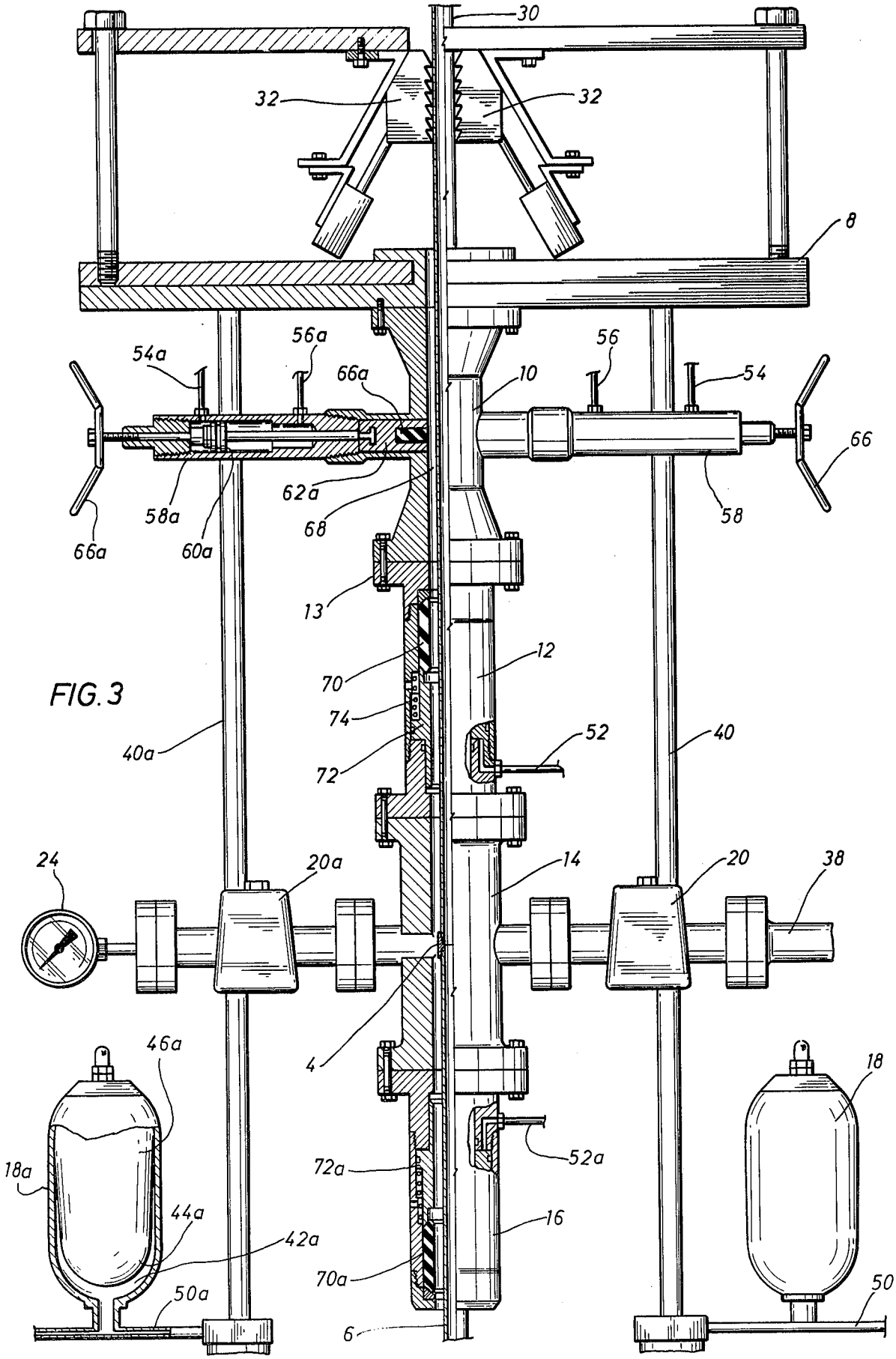
FIG. 3 is a partial cutaway view of the pressure control assembly.

Referring now to FIG. 3, a partial cutaway view of the pressure control assembly 13 is illustrated. An upper joint of pipe 30 and a lower joint of pipe 6 that are joined by threaded pipe connection 4 are shown contained within the pressure containing chamber 14. Suspended below the upper rotatable slip set assembly 8 is the pressure control assembly 13. Blowout preventor 10 is included in the pressure control assembly 13 to provide a means to stop the uncontrolled release of pressurized fluids and gases which are escaping from the open end of the tubing string once the upper joint of pipe 30 has been removed. Blowout preventor 10 is known by those skilled in the art as a "ram" type blowout preventor. The blowout preventor used in the embodiment of this invention is a standard model hydraulic blowout preventor manufactured by Cameron Oil Tools, but could also have been a heavy duty hydraulic blowout preventor manufactured by Bowen Oil Tools, Inc. or similar models from other manufacturers. This type of blowout preventor is actuated by pumping hydraulic fluid into a cylinder to cause a piston to push a ram into the central opening. If hydraulic pressure is not available, a manually actuated pusher may be used to push the ram into the opening. Dual cylinders and rams are provided, one on each side of the central opening, with each ram closing one half of the opening. The ram actuators 58 and 58*a* are identical in construction and operation and a discussion of only one will be provided.

Hydraulic fluid that is pumped into the ram actuator 58*a* through supply line 54*a*, forces piston 60*a* to move towards the central opening 68. This movement causes ram 62*a*, which is attached to the end of piston 60*a*, to begin closing off one half of the chamber of opening 68. A rubber insert 64*a* is mounted on the opposite end of ram 62*a* from where piston 60*a* is attached. Rubber insert 64*a* is compressed against a like insert from opposite side ram 62 (not shown) to form a pressure seal and close off the entire central opening 68. Ram 64*a* is opened by removing the pressure in fluid supply line 54*a* and pumping hydraulic fluid into supply line 56*a*. Pressurized fluid in line 56*a* forces piston 60*a* to move in the opposite direction as before to retract ram 62*a* from within the opening 68.

When pumped hydraulic fluid is not available, it is possible to open and close ram 62*a* by turning crank 66*a* to manually push and pull the piston 60*a*. It will be appreciated by those skilled in the art that other types of devices, such as a full opening valve, may be used to shut off the opening 68 to control the escaping fluids and gases from the open ended tubing string. A discussion of when and how the blowout preventor will be used is provided herein in the discussion of how the pressure control device is used.

Again referring to FIG. 3, suspended below blowout preventor 10 are the upper and lower sealing units 12 and 16, with a pressure-containing chamber 14 interposed between. The two sealing units 12 and 16 used in the embodiment of this invention are identical in operation and a discussion of only one will be provided. The sealing units are of standard manufacture such as those manufactured by Bowen Oil Tools. It will be appreciated by those skilled in the art that there are devices manufactured by other companies that may be used in place of the illustrated sealing units to generate a pressure seal around the pipe joints to be disconnected. In situations where the internal bore of the sealing units 12 and 16 are inadequate for the tools that will be pulled through the units or where there are exceptionally high well pressures involved, ram-type blowout preventors may be substituted for the illustrated sealing units 12 and 16 of FIG. 3. These substitute blowout preventors will be outfitted with pipe rams that will seal around the exterior wall of the tubing contained in the central opening 68.

Upper sealing unit 12 is actuated by pumping hydraulic fluid into the unit through supply line 52. This hydraulic pressure forces sealing ram 72 to move toward the rubber seal 70, forcing the seal to close uniformly around pipe joint 30 contained within central opening 68. Sealing ram 72 continues to urge rubber seal 70 against the pipe wall until a pressure seal is achieved. To release the pressure seal, hydraulic pressure is removed from supply line 52, thereby permitting return spring 74 to force sealing ram 72 to return to its relaxed position.

Pressure-containing chamber 14 is interposed between the upper and lower sealing units 12 and 16. Threaded pipe connection 4, which is to be uncoupled, is positioned within this chamber prior to disconnect. Attached to opposite sides of chamber 14 are two release valves, 20 and 20*a*. Attached to release valve 20*a* is a pressure gauge 24 that permits the crew to monitor the internal pressure within the chamber when release valve 20*a* is open. Attached to release valve 20 is pressure disposal line 38 that pipes the pressurized fluids and gases to a disposal area when release valve 20 is opened. The central opening of each of the elements that compose the pressure control assembly 13 are selected to have an inside diameter greater than the largest outside diameter of the drill string. This permits the pressure control device to remain in place while the string, containing tools or devices of greater diameter than the string tubing, is passing through the device.

Figure 2:
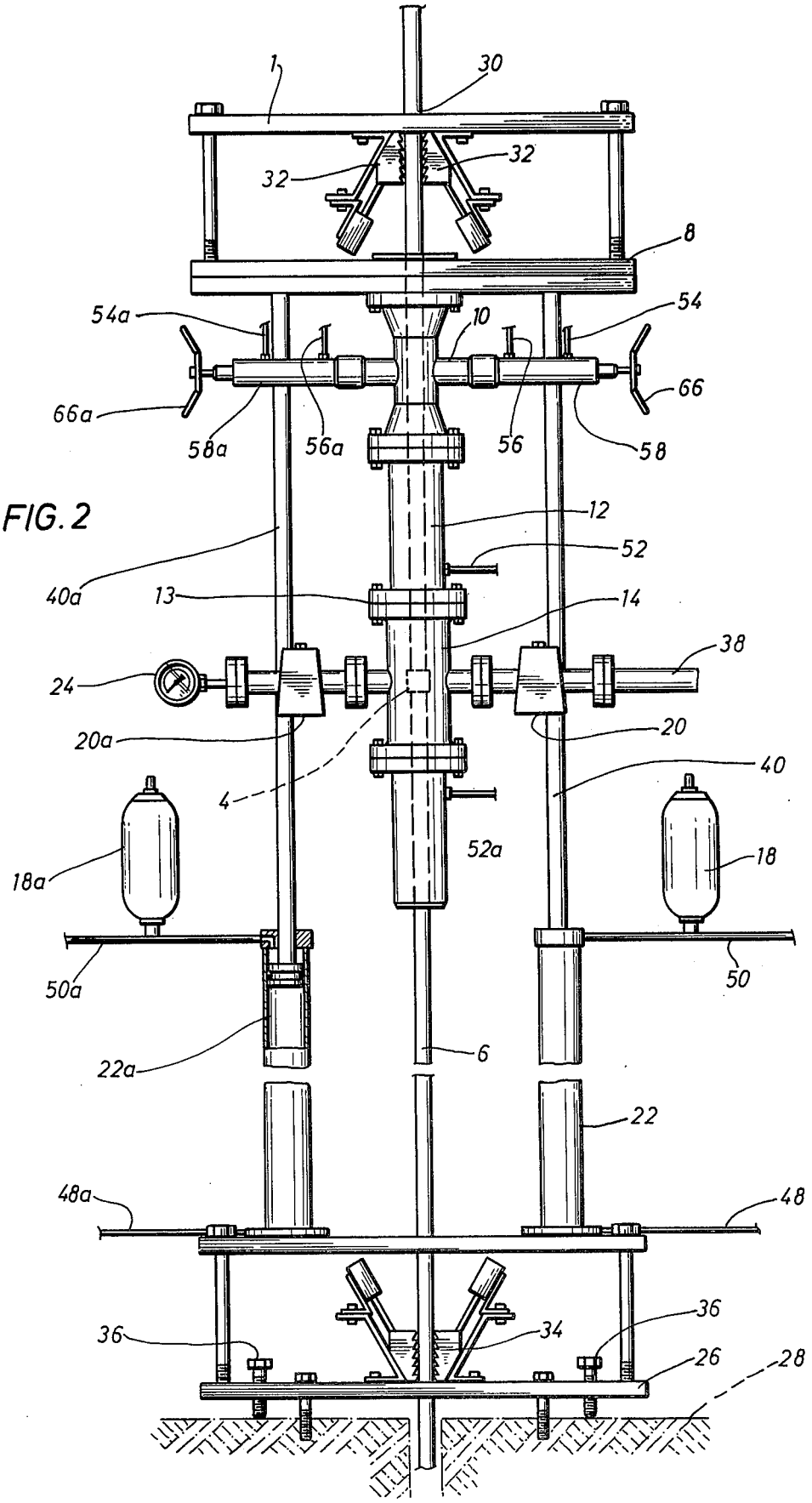
FIG. 2 is a partial cutaway side view of the pressure control device in its fully extended position with a threaded pipe connection positioned within the pressure control chamber.

Now turning to FIG. 2 which shows the pressure control device in its fully extended position, the upper set of slips 32, which are part of the upper rotatable slip set assembly 8, are shown engaging the outer surface of pipe joint 30. The gripping slots or teeth of the slips 32 are oriented so that the upper joint of pipe 30 is prevented from moving in an upwards direction in respect to the upper rotatable slip set assembly 8. The upper slips 32 perform two functions. First, in order to uncouple pipe joint 30 from pipe joint 6, pipe 30 must be rotated in the appropriate direction relative to pipe joint 6. This rotation is accomplished by rotation of the rotatable portion of the upper slip set assembly 8. This rotation is imparted to upper pipe joint 30 by the gripping action of slip set 32. During the rotation of the upper joint 30, lower joint 6 must be held stationary. Pipe joint 6 is held stationary by the lower slip set 34. Secondly, when pipe connection 4 is uncoupled, any released pressure will tend to force the upper joint 30 out of pressure control assembly 13. The gripping action of slip set 32 counteracts that expelling force and holds the pipe within the assembly.

FIG. 2 shows the lower set of slips 34, which are part of the lower slip set assembly 26, gripping lower pipe joint 6. The slots or teeth of the lower slip set 34 are oriented so that movement in a downwards direction is prevented. The lower slip set 34 serves two functions. First, the weight of the entire tubing string is supported by the lower slips, and secondly, the gripping action of the slips prevents lower pipe joint 6 from rotating while the upper joint of pipe 30 is rotated.

The lower stationary slip set assembly 26 provides a base platform to which the remaining elements of the pressure control device are mounted. Incorporated within the lower stationary slip set assembly is a set of alignment screws 36. The rig floor 28 (see FIG. 1), as a general rule, will not be perfectly level. Alignment screws 36 are provided to plumb the pressure control assembly 1 so that the longitudinal axis of the tubing string will be coaxial with the center line axis of the pressure control assembly 13. In this manner, as the tubing string is raised, contact with the inside surfaces of the pressure containing assembly will be minimized and the joints of pipe will pass through the assembly as smooth as possible. Although screws are used to plumb the device in the preferred embodiment, other ways to plumb the pressure control device could be used such as, hydraulic leveling pistons, jacks, etc.

The upper rotatable slip set assembly 8 is connected to the lower stationary slip set assembly 26 by means of two hydraulic piston assemblies. The hydraulic piston assemblies are identical in construction and operation and a description of only one will be given. Illustrated in FIG. 2 is a hydraulic piston assembly which is composed of a hydraulic cylinder 22*a* whose base is mounted to the lower stationary slip set assembly 26. Contained within cylinder 22*a* is piston 40*a*, one end of which is attached to the upper slip set assembly 8. Hydraulic fluid supply lines are provided at the top and bottom of cylinder 22*a*, respectively. By pumping fluid into cylinder 22*a* through line 48*a* and permitting the displaced fluid caused by the upward movement of piston 40*a* to escape through supply line 50*a*, piston 40*a* will be raised. To lower piston 40*a*, the process is reversed. Supply line 50*a* is pressurized and line 48*a* is allowed to drain.

Connected to supply line 50*a* is pressure accumulator 18*a*. The accumulator used in the preferred embodiment of this invention is of standard commercial design such as those manufactured by Greer Hydraulics, Inc., the capacity of which varies with the application. For an average application, the capacity of the accumulators is approximately five gallons. Contained within accumulator 18*a* is a flexible diaphram 44*a* that acts as a container for gas 46*a* and as an interface between the gas and the hydraulic fluid 42*a* that is delivered from the hydraulic fluid supply line 50*a*. The accumulator serves two functions. First, when upper pipe joint 30 is rotated to disconnect the threaded pipe connection 4, the length of pipe between the upper and lower slips, 32 and 34, increases. Accumulator 18*a* permits the slight upward extension of the upper slip set assembly 8 resulting from the unscrewing of the pipe connection 4. The upward movement of slip set assembly 8 causes piston 40*a* to likewise move up. The hydraulic fluid displaced by the upward movement of piston 40*a* enters accumulator 18*a*. This displaced fluid in turn compresses gas 46*a* as it enters the accumulator to accommodate the increased volume of fluid within the accumulator.

Secondly, accumulator 18*a* functions as a shock absorber to absorb the shock produced by the sudden release of pressure as pipe connection 4 is disconnected. Forces created by the released pressure tend to propel upper pipe joint 30 out of the pressure control assembly 13. Because the upper slip set 32 will not permit pipe joint 30 to move relative to the slip set assembly 8, this pressure-created force is transmitted to piston 40*a*. As piston 40*a* begins to move upwards, it displaces hydraulic fluid from cylinder 22*a* into supply line 50*a* and into accumulator 18*a*. This displaced fluid compresses gas 46*a* within the accumulator. Compression of gas 46*a* increases the pressure in the hydraulic fluid which in turn increases a counteracting force on piston 40*a* which retards the upward movement of the piston. As more fluid is displaced, the counteracting force acting on piston 40*a* is increased because the compressability of gas 46*a* has decreased. In this manner, the accumulator allows for limited rapid upward movement of pressure control assembly 13 created by the sudden release of pressure within the assembly by dissipating the generated forces in the compression of gas 46*a*.

The above-described pressure control device is employed in the following manner: Pressure control device 1 is first mounted to the rig floor and alignment screws 36 adjusted to plumb the assembly to align the center line axis of the assembly with the tubing string. The tubing string is raised until the threaded pipe connection 4 that is next to be disconnected is properly positioned with respect to the lower slip set. The lower slips are then set to firmly grip the lower joint of pipe to support the weight of the tubing string. Next, the pressure control assembly 13 is positioned so that the threaded pipe connection 4 is within the pressure control chamber by actuating the hydraulic piston assemblies. Now, the upper slip sets are set to rigidly grip the upper joint of pipe to be removed. A pressure seal above and below the threaded pipe connection is made by actuation of the upper and lower sealing units 12 and 16. The upper joint of pipe is then unscrewed by rotating the rotatable portion of the upper slip set assembly 8. Any released pressure, upon disconnect, is piped to a disposal area through release valve 20 in pressure disposal line 38. When the pressure within the pressure control chamber, as indicated on pressure gauge 24, is at a safe level, the pressure seals above and below the threaded pipe connection are released and the upper slip set disengaged.

The upper pipe joint is now removed from within the pressure control assembly. The pressure control assembly 13 is lowered by the hydraulic piston asemblies so the open end of the tubing string extends above the top of the pressure control device. With the open end of the tubing string positioned above the pressure control device, the crew can safely engage safety valve 2 into the threaded pipe connection. Having safely connected the safety valve to the pipe connection, the hoist then lifts the tubing string to permit the disengagment of the lower slip set. When the lower slips have been removed, the hoist raises the string to position the next threaded pipe connection to be disconnected at the proper position. At this point, the process of uncoupling the threaded pipe connection can be repeated as before.

Between the time that the upper joint of pipe has been uncoupled and removed from the pressure control assembly 13 and the time that safety valve 2 has been secured to the open end of the drill string, a blowout can occur in which pressurized fluids or gases begin to escape from the open end of the tubing string. In such a situation, the following steps will be carried out. If the unit has been lowered to expose the open end of the tubing string above the pressure control device and a blowout occurs, the pressure control assembly will be raised until the open end of the string is below blowout preventor 10 but above the lower sealing unit 16. The lower sealing unit 16 is actuated to form a seal about the pipe's exterior wall while blowout preventor 10 is closed. As a result, the uncontrolled release of fluids and gases is stopped. The released pressurized product may then be diverted to the disposal area through release valve 20. If the blowout occurs while the threaded pipe connection is contained within the pressure control assembly, the only action required to contain the blowout is to close blowout preventor 10 and cause lower sealing unit 16 to seal about the exterior wall of the lower joint of pipe.

Further modifications and alternative embodiments of the apparatus of this invention will be apparent to those skilled in the art in view of this description. Accordingly, this description is to be construed as illustrative only and is for the purpose of teaching those skilled in the art one manner of carrying out the invention. It is to be understood that the forms of the invention herein shown and described are to be taken as the presently preferred embodiments. Various changes may be made in the shape, size and arrangement of parts. For example, equivalent elements or materials may be substituted for those illustrated and described herein, parts may be reversed, and certain features of the invention may be utilized independently of those of other features, all would be apparent to one skilled in the art after having the benefit of this description of the invention.

What is claimed is:

1. A pressure control device for controlling the pressure around a threaded pipe connection in a tubing string held in place by an upper slip set which grips the string above said connection and a lower slip set which grips the string below said connection, said control device comprising:

a rotatable upper platform adapted for use with said upper slip set to enable rotation of a first joint of pipe above said connection and, to prevent upward movement of said first joint relative to said platform;

a stationary lower base adapted for use with said lower slip set to prevent rotation of a second joint of pipe below said connection and, to support the weight of said string;

means adapted for connection to said platform for forming a pressure containing enclosure around said threaded pipe connection, said connection joining said first joint to said second joint, said enclosure having a longitudinal opening;

pressure release means adapted for connection to said pressure enclosure means for the controlled release of pressure within said enclosure; and means adapted for connecting to said platform and to said base for longitudinally positioning said enclosure from a first position in which said connection protrudes above said platform to a second position in which said connection is contained within said enclosure.

2. The pressure control device according to claim 1 wherein said base further comprises means for plumbing said pressure control device so that the longitudinal axis of said opening of said pressure enclosure is coaxial with the longitudinal axis of said tubing string.

3. The pressure control device according to claim 1 wherein said pressure containing enclosure means comprises:

an upper and lower sealing unit for effecting a seal against the outer wall of said tubing string above and below said pipe connection, respectively;

a pressure chamber connecting said upper sealing unit to said lower sealing unit; and means connected to said upper sealing unit for closing the longitudinal opening of said enclosure above the open end of said string to shut off the uncontrolled flow of fluids or gases from said open end.

4. The pressure control device according to claim 3 wherein said means for enclosing the longitudinal opening of said enclosure comprises a blind opening ram blowout preventor.

5. The pressure control device according to claim 3 wherein said means for enclosing the longitudinal opening of said enclosure comprises a full opening valve.

6. The pressure control device of claim 3 wherein said longitudinal opening of said pressure enclosure has a diameter larger than the largest outside diameter of said string.

7. The control device according to claim 1 wherein said pressure release means comprises:

a pressure gauge connected to a first release valve from monitoring the internal pressure of said pressure enclosure, said first release valve connected to said pressure chamber; and a second release valve connected to said pressure chamber for releasing the pressure contained in said enclosure through a disposal line connected to said second release valve.

8. The pressure control device according to claim 1 wherein said positioning means comprises at least one hydraulic piston for positioning said pressure enclosure in relation to said threaded pipe connection.

9. The pressure control device according to claim 8 wherein said positioning means further comprises an accumulator hydraulically connected to said piston for absorbing the shock of released pressure forcing said first joint upwards when said connection is disengaged, and for allowing for slight upward movement of said platform as said connection is disconnected.

10. In a combination including a cylindrical pressurable container for surrounding a threaded connection in a tubing string being extracted from a well, the container having a longitudinal bore whose inside diameter is larger than the largest outside diameter of said string, the container including a lower sealing unit for closing the container against the outside wall of the tubing string below the threaded connection, an upper sealing unit longitudinally displaced therefrom for closing the container against the outside wall of the tubing string above the threaded connection, a bleed-off valve in the container for permiting exhaustion of pressurized gases and liquids escaping from the connection during disconnect, a lower gripper for supporting the tubing string below the container with respect to a base platform, an upper gripper for holding the portion of the tubing above the container to permit rotation to disconnection the connection located within the container, the improvement comprising:

an extensible connection supporting said container with respect to a base platform, to permit positioning of the container with respect to said connection independently of movement of the tubing string; and a blowout preventor connected to said upper sealing unit, for sealing off said longitudinal bore of said container above said upper sealing unit.

11. The device in accordance with claim 10, wherein said extensible connection includes at least one hydraulic piston for permitting the container to be lowered beneath the open end of the tubing string after disconnection of the connection has been completed.

12. The device in accordance with claim 11 and including an accumulator hydraulically connected to said hydraulic piston for providing shock absorbtion of upward movement of the tubing above the container in the presence of released pressure within the container, and for providing slight extension of the piston during disconnection of the connection.

13. The device in accordance with claim 10 wherein said base platform includes adjusting screws to plumb said arrangement so that the axis of said container bore is coaxial with the central axis of said tubing string.

14. A pressure control device for controlling the pressure around a threaded pipe connection in a tubing string, said device comprising:

a lower platform;

a lower set of grippers connected to said lower platform for gripping a lower joint of pipe in said tubing string, said lower grippers preventing downward movement of said joint;

an upper platform rotatable in respect to said lower platform;

an upper set of grippers connected to said upper platform for gripping an upper joint of pipe in said string, said upper grippers preventing upward movement of said upper joint in respect to said upper platform;

elevational positioning means connecting said upper platform to said lower platform for raising and lowering said upper platform in relation to said lower platform;

upper sealing means connected to said upper platform effectuating a pressure seal above said connection, said upper sealing means having a longitudinal opening through which said string passes;

a lower sealing unit for effectuating a pressure seal against the outside wall of said string below said connection, said lower sealing unit having a longitudinal opening through which said string passes; and a pressure cylinder connecting said upper sealing means to said lower sealing unit, said cylinder having a pressure release valve for controlled release of any pressurized liquids or gases released when said connection is disconnected and a longitudinal opening through which said string passes.

15. The pressure control device according to claim 14 wherein said elevational positioning means comprises:

at least one hydraulic piston for moving said upper platform from a first position in which said connection is above said upper platform to a second position in which said connection is contained within said cylinder; and an accumulator hydraulically connected to said piston to function as a shock absorber for upward forces produced when said connection is disconnected, and to allow for slight upward movement when said connection is being disconnected.

16. The pressure control device according to claim 14 wherein said upper sealing means further comprises:

a blowout preventor for closing off said longitudinal opening through which said string passes; and an upper sealing unit connected to said blowout preventor for effecting a pressure seal against the outside wall of said string.

17. The pressure control device according to claim 14 wherein the diameter of the longitudinal opening of said upper sealing means, said lower sealing unit and said pressure cylinder is larger than the largest outside diameter of said string.

18. In apparatus for use with a pressure-control device, said pressure-control device including a cylindrical pressurable container for surrounding a threaded connection in a tubing string being extracted from a well, the container having a longitudinal bore whose inside diameter is larger than the largest outside diameter of said string, the container including, (a) a lower sealing unit for closing the container against the outside wall of the tubing string below the threaded connection, (b) an upper sealing unit longitudinally displaced therefrom for closing the container against the outside wall of the tubing string above the threaded connection, (c) a bleed-off valve in the container to permit exhaustion of pressurized gases and liquids escaping from the connection during disconnect, (d) a lower gripper for supporting the tubing string below the container with respect to a base platform, and (e) an upper gripper for holding the portion of the tubing above the container to permit rotation to disconnect the connection located within the container, the improvement comprising:

(i) extensible means connectable to said base and to said container, to permit positioning of the container with respect to said connection independently of movement of the tubing string; and (ii) a blowout preventor connectable to said upper sealing unit, for sealing off said longitudinal bore of said container above said upper unit.

19. The improvement apparatus in accordance with claim 18, wherein said extensible means includes at least one hydraulic piston for permitting the container to be lowered beneath the exposed end of the tubing string after disconnection of the connection has been completed.

20. The improvement apparatus in accordance with claim 19 and including an accumulator hydraulically connected to said hydraulic piston for providing shock absorption of any upward movement of the tubing above the container in the presence of released pressure within the container, and for providing slight extension of the piston during disconnection of the connection.

21. The improvement apparatus in accordance with claim 20, further comprising adjusting screws to plumb said pressure control device such that the axis of said container bore is coaxial with the central axis of said tubing string.

* * * * *